US009654868B2

(12) United States Patent
Benattar

(10) Patent No.: US 9,654,868 B2
(45) Date of Patent: May 16, 2017

(54) MULTI-CHANNEL MULTI-DOMAIN SOURCE IDENTIFICATION AND TRACKING

(71) Applicant: STAGES PCS, LLC, Princeton, NJ (US)

(72) Inventor: Benjamin D. Benattar, Cranbury, NJ (US)

(73) Assignee: STAGES LLC, Ewing, NJ (US)

( * ) Notice: Subject to any disclaimer, the term of this patent is extended or adjusted under 35 U.S.C. 154(b) by 0 days.

(21) Appl. No.: 14/827,320

(22) Filed: Aug. 15, 2015

(65) Prior Publication Data

US 2016/0165340 A1 Jun. 9, 2016

Related U.S. Application Data

(63) Continuation-in-part of application No. 14/561,972, filed on Dec. 5, 2014.

(51) Int. Cl.
*H04R 1/40* (2006.01)
*H04R 1/10* (2006.01)
(Continued)

(52) U.S. Cl.
CPC ..... *H04R 1/406* (2013.01); *H04R 1/1008* (2013.01); *H04R 3/005* (2013.01); *H04R 5/033* (2013.01);
(Continued)

(58) Field of Classification Search
None
See application file for complete search history.

(56) References Cited

U.S. PATENT DOCUMENTS 3,806,919 A 4/1974 Comey
4,776,044 A 10/1988 Makins
(Continued)

FOREIGN PATENT DOCUMENTS

AU 2002300314 B2 2/2004
AU 2003236382 B2 3/2005
(Continued)

OTHER PUBLICATIONS

Jiang, Wentao, "Sound of silence": a secure indoor wireless ultrasonic communication system, School of Engineering—Electrical & Electronic Engineering, UCC, 2014, http://publish.ucc.ie/boolean/pdf/2014/00/09-iiang-2014-00-en.pdf, retrieved Nov. 24, 2015.
(Continued)

*Primary Examiner* — Paul Huber
(74) *Attorney, Agent, or Firm* — Mark E. Ungerman; Ungerman IP PLLC

(57) ABSTRACT

An audio source location, tracking and isolation system, particularly suited for use with person-mounted microphone arrays. The system increases capabilities by reducing resources required for certain functions so those resources can be utilized for result enhancing processes. A wide area scan may be utilized to identify the general vicinity of an audio source and a narrow scan to locate pinpoint positions may be initiated in the general vicinity identified by the wide area scan. Subsequent locations may be anticipated by compensating for motion of the sensor array and anticipated changes in source location by trajectory. Identification may use two or more sets of characterizations and rules. The characterizations may use computationally less intense analyzes to characterize audio and only perform computationally higher intensity analysis if needed. Rule sets may be used to eliminate the need to track audio sources that emit audio to be eliminated from an audio output.

14 Claims, 9 Drawing Sheets

(51) Int. Cl.
*H04R 3/00* (2006.01)
*H04R 5/033* (2006.01)

(52) U.S. Cl.
CPC .. *H04R 2201/401* (2013.01); *H04R 2201/405* (2013.01)

(56) References Cited

U.S. PATENT DOCUMENTS 5,432,858 A 7/1995 Clair, Jr. et al.
5,581,620 A 12/1996 Brandstein et al.
5,619,582 A 4/1997 Oltman et al.
5,638,343 A 6/1997 Ticknor
5,668,884 A 9/1997 Clair, Jr. et al.
5,737,431 A 4/1998 Brandstein et al.
5,764,778 A 6/1998 Zurek
5,778,082 A 7/1998 Chu et al.
5,793,875 A 8/1998 Lehr et al.
5,822,440 A 10/1998 Oltman et al.
6,462,808 B2 10/2002 Paritsky et al.
RE38,405 E 1/2004 Clair, Jr. et al.
6,959,075 B2 10/2005 Cutaia et al.
7,110,552 B1 9/2006 Saliterman
D552,077 S 10/2007 Brunner et al.
7,415,117 B2 8/2008 Tashev et al.
7,583,808 B2 9/2009 Smaragdis et al.
7,613,305 B2 11/2009 Vieilledent et al.
7,620,409 B2 11/2009 Budampati et al.
7,817,805 B1 10/2010 Griffin
7,848,512 B2 12/2010 Eldracher
7,970,150 B2 6/2011 Oxford
D641,725 S 7/2011 Chong et al.
7,995,770 B1 8/2011 Simon
8,064,607 B2 11/2011 Monceaux et al.
8,150,054 B2 4/2012 Andrea et al.
8,155,346 B2 4/2012 Yoshizawa et al.
8,194,873 B2 6/2012 Pan et al.
8,229,740 B2 7/2012 Nordholm et al.
8,290,174 B1 10/2012 Simon
8,379,874 B1 2/2013 Simon
8,483,396 B2 7/2013 Amadu et al.
8,521,316 B2 8/2013 Louboutin
8,542,843 B2 9/2013 Andrea et al.
8,577,053 B1 11/2013 Simon
8,612,187 B2 12/2013 Amadu
8,768,496 B2 7/2014 Katz et al.
8,861,756 B2 * 10/2014 Zhu ..... H04R 3/005 381/300
8,873,767 B2 10/2014 Regler
8,917,506 B2 12/2014 Diebel et al.
8,934,635 B2 1/2015 Esnault et al.
9,087,506 B1 7/2015 Kraft et al.
9,111,529 B2 8/2015 Amadu et al.
9,112,464 B2 8/2015 Amadu et al.
9,113,264 B2 8/2015 Frater
9,131,308 B2 9/2015 Kraft et al.
9,226,088 B2 12/2015 Pandey et al.
2005/0117771 A1 6/2005 Vosburgh et al.
2006/0056638 A1 3/2006 Schobben
2007/0030986 A1 2/2007 McArthur et al.
2008/0174665 A1 7/2008 Enstad et al.
2009/0010443 A1 1/2009 Ahnert et al.
2010/0034396 A1 2/2010 Wollmershauser et al.
2010/0141153 A1 6/2010 Recker
2010/0239105 A1 9/2010 Pan
2010/0284525 A1 11/2010 Sander et al.
2011/0025912 A1 2/2011 Regler
2011/0081024 A1 4/2011 Soulodre
2011/0127623 A1 6/2011 Fueldner et al.
2012/0020485 A1 * 1/2012 Visser ..... H04R 3/005 381/57
2012/0087507 A1 4/2012 Meyer
2012/0183163 A1 7/2012 Apfel
2013/0035777 A1 2/2013 Niemisto et al.
2013/0082875 A1 * 4/2013 Sorensen ..... G10K 11/34 342/368
2013/0121505 A1 5/2013 Duraiswami et al.
2014/0044275 A1 2/2014 Goldstein et al.
2014/0093093 A1 4/2014 Dusan et al.
2014/0184386 A1 7/2014 Regler
2014/0200054 A1 7/2014 Fraden
2014/0270217 A1 * 9/2014 Ivanov ..... H04R 29/005 381/66
2014/0270231 A1 * 9/2014 Dusan ..... G10L 25/90 381/74
2014/0270254 A1 9/2014 Oishi et al.
2014/0301568 A1 10/2014 Amadu et al.
2015/0054913 A1 2/2015 Annau et al.
2015/0055937 A1 2/2015 Van Hoff et al.
2015/0058102 A1 2/2015 Christensen et al.
2015/0095026 A1 4/2015 Bisani et al.
2015/0193195 A1 7/2015 Lin et al.
2015/0201271 A1 7/2015 Diethorn et al.
2015/0206524 A1 7/2015 Kraft et al.
2015/0208170 A1 7/2015 Kraft et al.
2015/0234156 A1 8/2015 Rondinelli et al.
2015/0312671 A1 10/2015 Wiggins et al.
2015/0312677 A1 10/2015 Kraft et al.
2015/0348580 A1 12/2015 van Hoff et al.
2015/0355880 A1 12/2015 Kraft et al.
2015/0373474 A1 12/2015 Kraft et al.
2015/0382096 A1 12/2015 Lamar et al.
2015/0382106 A1 12/2015 Kraft et al.
2016/0055861 A1 2/2016 Kraft et al.
2016/0057526 A1 2/2016 Jaffe et al.

FOREIGN PATENT DOCUMENTS

CN 103229160 A1 7/2013
DE 102004025533 A1 12/2005
EP 0653144 B1 2/1998
WO WO2012048299 A1 4/2012
WO 2014096861 A2 6/2014

OTHER PUBLICATIONS

Kendall, Gary S., A 3-D Sound Primer: Directional Hearing and Stereo Reproduction, Computer Music Journal, vol. 19, No. 4 (Winter, 1995), pp. 23-46.
Lu, Yan-Chen; Cooke, Martin, Motion strategies for binaural localisation of speech sources in azimuth and distance by artificial listeners, Speech Comm. (2010) , Jun. 12, 2010, ScienceDirect.
Conexant, Conexant AudioSmart Voice & Speech Processing White Paper, Feb. 12, 2014, pp. 1-19.
Parra, Lucas; Fancourt, Craig, An Adaptive Beamforming Perspective on Convolutive Blind Source Separation, Samoff Corporation, Noise Reduction in Speech Applications, Ed. G. Davis, CRC Press, 2002, Princeton, NJ, pp. 1-18.
Geronazzo, Michelle; Bedin, Alberto; Brayda, Luca; Campus, Claudio; Avanzini, Federico, Interactive spatial sonification for non-visual exploration of virtual maps, Int. J. Human-Computer Studies, 85(2016) 4-15, 2015 Elsevier Ltd.
Mannion, Patrick, Teardown: Analog Rules Over Digital in Noise-Canceling Headphones, EDN Network, Jan. 11, 2013, 3 pages, USA.
Singh, Aarti, Adaptive Noise Cancellation, Dept. of Electronics & Communication, Netaji Subhas Institute of Technology, 2001, 52 pages, India.
Jezierny, M., Keller, B., Lee, K.Y., Digital Active Noise Cancelling Headphones, School of Engineering and Applied Science, Electrical and Systems Engineering Department, Washington University in St. Louis, May 2010, 25 pages, USA.
Elliott, S.J., Nelson, P.A., Active Noise Control—Low-frequency techniques for suppressing acoustic noise leap forward with signal processing, IEEE Signal Processing Magazine, Oct. 1993, 24 pages, USA.
STMicroelectronics, STA311B Multichannel digital audio processor with FFX Datasheet, Oct. 2013, 102 pages, USA.
Maxim, Audio Design Guide, 12th Edition, Dec. 2009, 20 pages, USA.

(56) References Cited

OTHER PUBLICATIONS

STMicroelectronics, STA308A Multi-channel digital audio processor with DDX Datasheet, Jul. 2007, 63 pages, USA.
FRANKFSP, ConcertTronix! The Revolutionary New Way to Attend, Listen and Record Live Concerts with Your Mobile Device!, Sep. 12, 2012, 4 pages, USA.
AustriaMicroSystems AG—AMS AG, AS3501 AS3502 Low Power Ambient Noise-Cancelling Speaker Driver DataSheet, 997-2009, 45 pages, Austria.
AustriaMicroSystems AG, AS3421/22 Low Power Ambient Noise-Cancelling Speaker Driver DataSheet, 1997-2013, 61 pages, Austria.
Kuo, Sen M. and Morgan, Dennis, R., Active Noise Control: A Tutorial Review, Proceedings of the IEEE, vol. 87, No. 6, Jun. 1999, pp. 943-973, USA.
Kuo, S.M., Panahi, I., Chung, K.M., Horner, T., Nadeski, M., Chyan, J., Design of Active Noise Control Systems with the TMS320 Family Application Report, Texas Instruments Digital Signal Processing Solutions, 1996, 171 pages, USA.
Chowdhry, Amit, 26 Best Noise Cancelling Headphones, Pulse2.0 Technology News Since 2006, Nov. 28, 2012, http://pulse2.com/2012/11/28/best-noise-canceling-headphones/, 18 pages, USA.
Baldwin, Richard G., Adaptive Noise Cancellation Using Java, Java Programing Notes #2360, Apr. 18, 2006, http://www.developer.com/java/other/article.php/3599661/Adaptive-Noise-Cancellation-Using-Java.htm, 15 pages, USA.
FMA Solutions, Inc., Best Noise Canceling Earphones, Westone Noise Canceling Earphones, 2014, earphonesolutions.com/coofsoiseaan.html, 3 pages, Orlando, FL, USA.
Albing, Brad, Noise-Reducing Headphones Hide Analog Heart, Jan. 24, 2013, http://www.planetanalog.com/author.asp?section_id=385& doc_id=558728, 4 pages, USA.
Ruckus Wireless, Inc., Best Practice Design Guide: Deploying Very High Density Wi-Fi—Design and Configuration Guide for Stadiums, http://c541678.r78.cf2.rackcdn.com/appnotes/bpg-highdensity.pdf, 2012, 52 pages, USA.
CNET TV, Monoprice's Noise Cancelling Headphone tries to silence critics, http://scienceheap.com/?rvq, https://www.youtube.com/watch?v=h8_PDtXQu58#t=89, Apr. 10, 2013, 2 pages, USA.
Haynes, Toby, A Primer on Digital Beamforming, Mar. 26, 1988, www.spectrumsignal.com, 15 pages, British Columbia, Canada.
Reppetto, Stafania and Trucco, Andrea, Designing Superdirective Microphone Arrays with a Frequency Invariant Beam Pattern, IEEE Sensors Journal, vol. 6, No. 3, Jun. 2006, pp. 737-747, Genova, Italy.
Zaunschirm, Markus and Zotter, Franz, Measurement-Based Modal Beamforming Using Planar Circular Microphone Arrays, Proc. of the EAA Joint Symposium on Auralization and Ambisonics, Apr. 3-5, 2014, pp. 75-80, Berlin, Germany.
Dualta, Currie, Shedding Some Light on Voice Authentication, SANS Institute InfoSec Reading Room, 2003, 17 pages, USA.
miniDSP Ltd., Digital Crossover Basics, www.minidsp.com/, 2009-2014, 4 pages, Hong Kong.
LaValle S. M., Yershova A., Katsev M., Antonov M. (2014). "Head Tracking for the Oculus Rift," Proceedings of the IEEE International Conference on Robotics and Automation, 187-194.

* cited by examiner

MULTI-CHANNEL MULTI-DOMAIN SOURCE IDENTIFICATION AND TRACKING

CROSS REFERENCE TO RELATED APPLICATIONS

This application is a continuation-in-part and is a continuation-in-part of and claims priority from U.S. patent application Ser. No. 14/561,972 filed Dec. 5, 2014, U.S. Pat. No. 9,608,335 B2. The subject matter of this application is related to U.S. patent application Ser. Nos. 14/827,315; 14/827,316; 14/827,317; 14/827,319; and Ser. No. 14/827,322.

BACKGROUND OF THE INVENTION

1. Field of the Invention

The invention relates to audio processing and in particular to systems that isolate the location of an audio source, classify the audio from the source, and process the audio in accordance with the classification.

2. Description of the Related Technology

It is known to use microphone arrays and beamforming technology in order to locate and isolate an audio source. Personal audio is typically delivered to a user by headphones. Headphones are a pair of small speakers that are designed to be held in place close to a user's ears. They may be electroacoustic transducers which convert an electrical signal to a corresponding sound in the user's ear. Headphones are designed to allow a single user to listen to an audio source privately, in contrast to a loudspeaker which emits sound into the open air, allowing anyone nearby to listen. Earbuds or earphones are in-ear versions of headphones.

A sensitive transducer element of a microphone is called its element or capsule. Except in thermophone based microphones, sound is first converted to mechanical motion by means of a diaphragm, the motion of which is then converted to an electrical signal. A complete microphone also includes a housing, some means of bringing the signal from the element to other equipment, and often an electronic circuit to adapt the output of the capsule to the equipment being driven. A wireless microphone contains a radio transmitter.

The condenser microphone, is also called a capacitor microphone or electrostatic microphone. Here, the diaphragm acts as one plate of a capacitor, and the vibrations produce changes in the distance between the plates.

A fiber optic microphone converts acoustic waves into electrical signals by sensing changes in light intensity, instead of sensing changes in capacitance or magnetic fields as with conventional microphones. During operation, light from a laser source travels through an optical fiber to illuminate the surface of a reflective diaphragm. Sound vibrations of the diaphragm modulate the intensity of light reflecting off the diaphragm in a specific direction. The modulated light is then transmitted over a second optical fiber to a photo detector, which transforms the intensity-modulated light into analog or digital audio for transmission or recording. Fiber optic microphones possess high dynamic and frequency range, similar to the best high fidelity conventional microphones. Fiber optic microphones do not react to or influence any electrical, magnetic, electrostatic or radioactive fields (this is called EMI/RFI immunity). The fiber optic microphone design is therefore ideal for use in areas where conventional microphones are ineffective or dangerous, such as inside industrial turbines or in magnetic resonance imaging (MRI) equipment environments.

Fiber optic microphones are robust, resistant to environmental changes in heat and moisture, and can be produced for any directionality or impedance matching. The distance between the microphone's light source and its photo detector may be up to several kilometers without need for any preamplifier or other electrical device, making fiber optic microphones suitable for industrial and surveillance acoustic monitoring. Fiber optic microphones are suitable for use application areas such as for infrasound monitoring and noise-canceling.

U.S. Pat. No. 6,462,808 B2, the disclosure of which is incorporated by reference herein shows a small optical microphone/sensor for measuring distances to, and/or physical properties of, a reflective surface The MEMS (MicroElectrical-Mechanical System) microphone is also called a microphone chip or silicon microphone. A pressure-sensitive diaphragm is etched directly into a silicon wafer by MEMS processing techniques, and is usually accompanied with integrated preamplifier. Most MEMS microphones are variants of the condenser microphone design. Digital MEMS microphones have built in analog-to-digital converter (ADC) circuits on the same CMOS chip making the chip a digital microphone and so more readily integrated with modern digital products. Major manufacturers producing MEMS silicon microphones are Wolfson Microelectronics (WM7xxx), Analog Devices, Akustica (AKU200x), Infineon (SMM310 product), Knowles Electronics, Memstech (MSMx), NXP Semiconductors, Sonion MEMS, Vesper, AAC Acoustic Technologies, and Omron.

A microphone's directionality or polar pattern indicates how sensitive it is to sounds arriving at different angles about its central axis. The polar pattern represents the locus of points that produce the same signal level output in the microphone if a given sound pressure level (SPL) is generated from that point. How the physical body of the microphone is oriented relative to the diagrams depends on the microphone design. Large-membrane microphones are often known as "side fire" or "side address" on the basis of the sideward orientation of their directionality. Small diaphragm microphones are commonly known as "end fire" or "top/end address" on the basis of the orientation of their directionality.

Some microphone designs combine several principles in creating the desired polar pattern. This ranges from shielding (meaning diffraction/dissipation/absorption) by the housing itself to electronically combining dual membranes.

An omnidirectional (or nondirectional) microphone's response is generally considered to be a perfect sphere in three dimensions. In the real world, this is not the case. As with directional microphones, the polar pattern for an "omnidirectional" microphone is a function of frequency. The body of the microphone is not infinitely small and, as a consequence, it tends to get in its own way with respect to sounds arriving from the rear, causing a slight flattening of the polar response. This flattening increases as the diameter of the microphone (assuming it's cylindrical) reaches the wavelength of the frequency in question.

A unidirectional microphone is sensitive to sounds from only one direction.

A noise-canceling microphone is a highly directional design intended for noisy environments. One such use is in aircraft cockpits where they are normally installed as boom microphones on headsets. Another use is in live event support on loud concert stages for vocalists involved with live performances. Many noise-canceling microphones combine signals received from two diaphragms that are in opposite electrical polarity or are processed electronically. In dual diaphragm designs, the main diaphragm is mounted closest to the intended source and the second is positioned farther away from the source so that it can pick up environmental sounds to be subtracted from the main diaphragm's signal. After the two signals have been combined, sounds other than the intended source are greatly reduced, substantially increasing intelligibility. Other noise-canceling designs use one diaphragm that is affected by ports open to the sides and rear of the microphone.

Sensitivity indicates how well the microphone converts acoustic pressure to output voltage. A high sensitivity microphone creates more voltage and so needs less amplification at the mixer or recording device. This is a practical concern but is not directly an indication of the microphone's quality, and in fact the term sensitivity is something of a misnomer, "transduction gain" being perhaps more meaningful, (or just "output level") because true sensitivity is generally set by the noise floor, and too much "sensitivity" in terms of output level compromises the clipping level.

A microphone array is any number of microphones operating in tandem. Microphone arrays may be used in systems for extracting voice input from ambient noise (notably telephones, speech recognition systems, hearing aids), surround sound and related technologies, binaural recording, locating objects by sound: acoustic source localization, e.g., military use to locate the source(s) of artillery fire, aircraft location and tracking.

Typically, an array is made up of omnidirectional microphones, directional microphones, or a mix of omnidirectional and directional microphones distributed about the perimeter of a space, linked to a computer that records and interprets the results into a coherent form. Arrays may also be formed using numbers of very closely spaced microphones. Given a fixed physical relationship in space between the different individual microphone transducer array elements, simultaneous DSP (digital signal processor) processing of the signals from each of the individual microphone array elements can create one or more "virtual" microphones.

Beamforming or spatial filtering is a signal processing technique used in sensor arrays for directional signal transmission or reception. This is achieved by combining elements in a phased array in such a way that signals at particular angles experience constructive interference while others experience destructive interference. A phased array is an array of antennas, microphones or other sensors in which the relative phases of respective signals are set in such a way that the effective radiation pattern is reinforced in a desired direction and suppressed in undesired directions. The phase relationship may be adjusted for beam steering. Beamforming can be used at both the transmitting and receiving ends in order to achieve spatial selectivity. The improvement compared with omnidirectional reception/transmission is known as the receive/transmit gain (or loss).

Adaptive beamforming is used to detect and estimate a signal-of-interest at the output of a sensor array by means of optimal (e.g., least-squares) spatial filtering and interference rejection.

To change the directionality of the array when transmitting, a beamformer controls the phase and relative amplitude of the signal at each transmitter, in order to create a pattern of constructive and destructive interference in the wavefront. When receiving, information from different sensors is combined in a way where the expected pattern of radiation is preferentially observed.

With narrow-band systems the time delay is equivalent to a "phase shift", so in the case of a sensor array, each sensor output is shifted a slightly different amount. This is called a phased array. A narrow band system, typical of radars or small microphone arrays, is one where the bandwidth is only a small fraction of the center frequency. With wide band systems this approximation no longer holds, which is typical in sonars.

In the receive beamformer the signal from each sensor may be amplified by a different "weight." Different weighting patterns (e.g., Dolph-Chebyshev) can be used to achieve the desired sensitivity patterns. A main lobe is produced together with nulls and sidelobes. As well as controlling the main lobe width (the beam) and the sidelobe levels, the position of a null can be controlled. This is useful to ignore noise or jammers in one particular direction, while listening for events in other directions. A similar result can be obtained on transmission.

Beamforming techniques can be broadly divided into two categories:

a. conventional (fixed or switched beam) beamformers
b. adaptive beamformers or phased array
   i. desired signal maximization mode
   ii. interference signal minimization or cancellation mode Conventional beamformers use a fixed set of weightings and time-delays (or phasings) to combine the signals from the sensors in the array, primarily using only information about the location of the sensors in space and the wave directions of interest. In contrast, adaptive beamforming techniques generally combine this information with properties of the signals actually received by the array, typically to improve rejection of unwanted signals from other directions. This process may be carried out in either the time or the frequency domain.

As the name indicates, an adaptive beamformer is able to automatically adapt its response to different situations. Some criterion has to be set up to allow the adaption to proceed such as minimizing the total noise output. Because of the variation of noise with frequency, in wide band systems it may be desirable to carry out the process in the frequency domain.

Beamforming can be computationally intensive.

Beamforming can be used to try to extract sound sources in a room, such as multiple speakers in the cocktail party problem. This requires the locations of the speakers to be known in advance, for example by using the time of arrival from the sources to mics in the array, and inferring the locations from the distances.

A Primer on Digital Beamforming by Toby Haynes, Mar. 26, 1998 http://www.spectrumsignal.com/publications/beamform_primer.pdf describes beam forming technology.

According to U.S. Pat. No. 5,581,620, the disclosure of which is incorporated by reference herein, many communication systems, such as radar systems, sonar systems and microphone arrays, use beamforming to enhance the reception of signals. In contrast to conventional communication systems that do not discriminate between signals based on the position of the signal source, beamforming systems are characterized by the capability of enhancing the reception of signals generated from sources at specific locations relative to the system.

Generally, beamforming systems include an array of spatially distributed sensor elements, such as antennas, sonar phones or microphones, and a data processing system for combining signals detected by the array. The data processor combines the signals to enhance the reception of signals from sources located at select locations relative to the sensor elements. Essentially, the data processor "aims" the sensor array in the direction of the signal source. For example, a linear microphone array uses two or more microphones to pick up the voice of a talker. Because one microphone is closer to the talker than the other microphone, there is a slight time delay between the two microphones. The data processor adds a time delay to the nearest microphone to coordinate these two microphones. By compensating for this time delay, the beamforming system enhances the reception of signals from the direction of the talker, and essentially aims the microphones at the talker.

A beamforming apparatus may connect to an array of sensors, e.g. microphones that can detect signals generated from a signal source, such as the voice of a talker. The sensors can be spatially distributed in a linear, a two-dimensional array or a three-dimensional array, with a uniform or non-uniform spacing between sensors. A linear array is useful for an application where the sensor array is mounted on a wall or a podium talker is then free to move about a half-plane with an edge defined by the location of the array. Each sensor detects the voice audio signals of the talker and generates electrical response signals that represent these audio signals. An adaptive beamforming apparatus provides a signal processor that can dynamically determine the relative time delay between each of the audio signals detected by the sensors. Further, a signal processor may include a phase alignment element that uses the time delays to align the frequency components of the audio signals. The signal processor has a summation element that adds together the aligned audio signals to increase the quality of the desired audio source while simultaneously attenuating sources having different delays relative to the sensor array. Because the relative time delays for a signal relate to the position of the signal source relative to the sensor array, the beamforming apparatus provides, in one aspect, a system that "aims" the sensor array at the talker to enhance the reception of signals generated at the location of the talker and to diminish the energy of signals generated at locations different from that of the desired talker's location. The practical application of a linear array is limited to situations which are either in a half plane or where knowledge of the direction to the source in not critical. The addition of a third sensor that is not co-linear with the first two sensors is sufficient to define a planar direction, also known as azimuth. Three sensors do not provide sufficient information to determine elevation of a signal source. At least a fourth sensor, not co-planar with the first three sensors is required to obtain sufficient information to determine a location in a three dimensional space.

Although these systems work well if the position of the signal source is precisely known, the effectiveness of these systems drops off dramatically and computational resources required increases dramatically with slight errors in the estimated a priori information. For instance, in some systems with source-location schemes, it has been shown that the data processor must know the location of the source within a few centimeters to enhance the reception of signals. Therefore, these systems require precise knowledge of the position of the source, and precise knowledge of the position of the sensors. As a consequence, these systems require both that the sensor elements in the array have a known and static spatial distribution and that the signal source remains stationary relative to the sensor array. Furthermore, these beamforming systems require a first step for determining the talker position and a second step for aiming the sensor array based on the expected position of the talker.

A change in the position and orientation of the sensor can result in the aforementioned dramatic effects even if the talker is not moving due to the change in relative position and orientation due to movement of the arrays. Knowledge of any change in the location and orientation of the array can compensate for the increase in computational resources and decrease in effectiveness of the location determination and sound isolation. An accelerometer is a device that measures acceleration of an object rigidly inked to the accelerometer. The acceleration and timing can be used to determine a change in location and orientation of an object linked to the accelerometer.

U.S. Pat. No. 7,415,117 shows audio source location, identification, and isolation. Known systems rely on stationary microphone arrays.

SUMMARY OF THE INVENTION

It is an object of the invention to provide an audio customization system to enhance a user's audio environment. One type of enhancement would allow a user to wear headphones and specify what ambient audio and source audio will be transmitted to the headphones.

In order to provide enhanced ambient audio to the users, an object of the invention is to isolate audio from desired audio sources and attenuate undesirable audio. One technique for isolating desirable audio is the use of beamforming technology to locate and track an audio source. Audio processing to characterize the audio emanating from the source and beam-steering technology to isolate the audio from the audio source location.

A source location identification unit uses beamforming in cooperation with a microphone array to identify the location of an audio source. In order to enhance efficiency the location of a source can be identified in two modes. A wide-scanning mode can be utilized to identify the vicinity or direction of an audio source with respect to a microphone array and a narrow scan may be utilized to pinpoint an audio source. The source location unit(s) may cooperate with a location table. The source location unit(s) can store the wide location of an identified source in the location table. The wide location unit is intended to determine the general vicinity of an audio source. The narrow source location is intended to identify a pinpoint location and store the pinpoint location in a pinpoint location table. Because the operation of a narrow source location unit is computationally intensive, the scope of the narrow location scan can be limited to the vicinity of the sources identified in the wide location scan. The source location unit may perform a wide source location scan to identify the general vicinity of one or more audio sources and may be limited, or at least initiated, at a point in the general vicinity identified by the wide source location scan. The wide source location scan and the narrow source location scan may be executed on different schedules. The narrow source location scan should be performed on a more frequent schedule so that audio emanating from said pinpoint locations may be processed for further use or consumption.

The location table may be updated in order to reduce the processing required to accomplish the pinpoint scans. The location table may be adjusted by adding a location compensation dependent on changes in position and orientation of the sensor array. In order to adjust the locations for changes in position and orientation of the sensor array, an accelerometer may be rigidly linked to the sensor array to determine changes in the location and orientation of the microphone array. The array motion compensation may be added to the pinpoint location stored in the location table. In this way the narrow source location can update the relative location of sources based on motion of the sensor arrays. The location table may also be updated on the basis of trajectory. If over time an audio source presents from different locations based on motion of the audio source, the differences may be utilized to predict additional motion and the location table can be updated on the basis of predicted source location movement. The location table may track one or more audio sources.

The locations stored in the location table may be utilized by a beam-steering unit to focus the sensor array on the locations and to capture isolated audio from the specified location. The location table may be utilized to control the schedule of the beam steering unit on the basis of analysis of the audio from each of the tracked sources.

Audio obtained from each tracked source may undergo an identification process. The audio may be processed through a set of parameters in order to identify or classify the audio and to treat audio from that source in accordance with a rule specifying the manner of treatment. The processing may be multi-channel and/or multi-domain processes in order to characterize the audio and a rule set may be applied to the characteristics in order to ascertain treatment of audio from the particular source. Multi-channel and multi-domain processing can be computationally intensive. The result of the multi-channel/multi-domain processing that most closely fits a rule will indicate the treatment to be applied. If the rule indicates that the source is of interest, the pinpoint location table may be updated and a scanning schedule may be set. Certain audio may justify higher frequency scanning and capture than other audio. For example speech or music of interest may be sampled at a higher frequency than an alarm or a siren of interest.

The computational resources may be conserved in some situations. Some audio information may be more easily characterized and identified than other audio information. For example, the aforementioned siren may be relatively uniform and easy to identify. A gross characterization process may be utilized in order to identify audio sources which do not require computationally intense processing of the multi-channel/multi-domain processing unit. If a gross characterization is performed a ruleset may be applied to the gross characterization in order to indicate whether audio from the source should be ignored, should be isolated based on the gross characterization alone, or should be subjected to further analysis such as the multi-channel/multi-domain processing which is computationally intensive. The location table may be updated on the basis of the result of the gross characterization.

In this way the computationally intensive functions may be driven by the location table and the location table settings may operate to conserve computational resources required. The wide area source location operates to add sources to the source location table at a relatively lower frequency than needed for user consumption of the audio. Successive processing iterations update the location table to reduce the number of sources being tracked with a pinpoint scan, to predict the location of the sources to be tracked with a pinpoint scan to reduce the number of locations that are isolated by the beam-steering unit and reduce the processing required for the multi-channel/multi-domain analysis.

An audio processing system having a body mounted microphone array; an accelerometer linked to the microphone array; an audio source locating unit connected to the microphone array having an output representative of a location of an audio source; a location table connected to the output of the audio source locating unit containing a representation of a location of one or more audio sources; and an array displacement compensation unit having an input connected to an output of the accelerometer and an output representative of a change in position of the accelerometer. The location table is responsive to the output representative of a change in position of the accelerometer to update the representation of the one or more audio sources to compensate for the change in position of the accelerometer.

A localized audio capture unit may be connected to the microphone array and the location table to capture and isolate audio information from one or more locations specified by the representation of a location of the one or more audio sources.

An audio processing system may have an audio output connected to the audio capture unit.

An audio analysis unit may have an input connected to the audio capture unit and gating logic responsive to an output of the audio analysis unit.

An output of the gating logic may be connected to the location table.

The audio analysis unit may be configured to perform two or more sets of audio analysis operations.

The audio processing system may have a source movement prediction unit having an input connected to the location table and an output representative of anticipated change of audio source location based on trajectory of audio source locations over time, connected to the location table, wherein the location table is responsive to said output of the source movement prediction unit to update the representation of said location of said audio source.

One set of audio analysis operations may be a set of gross characterization operations.

One set of audio analysis operations may be a set of multi-channel analysis operations and/or a set of multi-domain analysis operations.

DETAILED DESCRIPTION OF PREFERRED EMBODIMENTS

Figure 1:
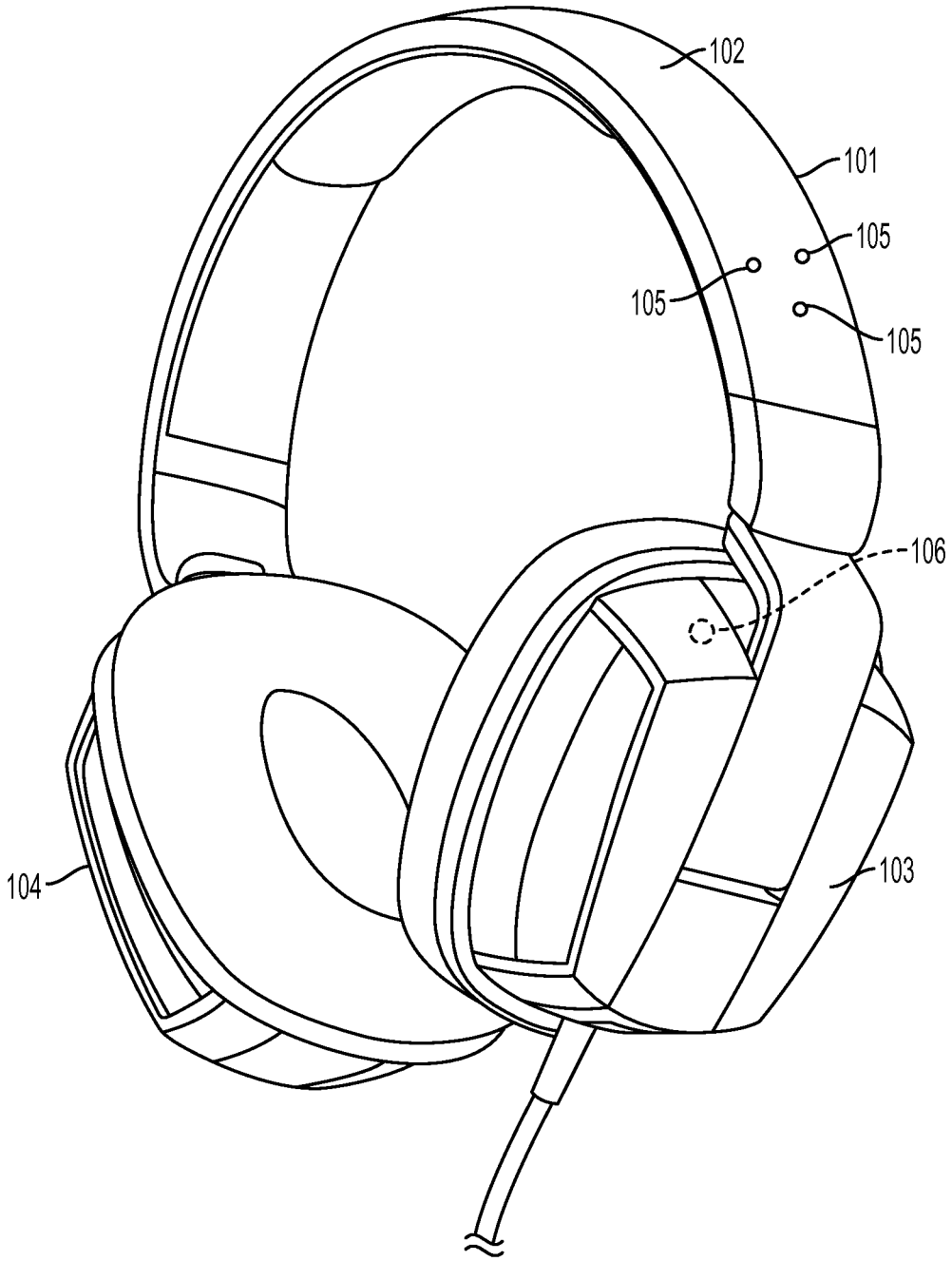
FIG. 1 shows a pair of headphones with an embodiment of a microphone array according to the invention.
Figure 2:
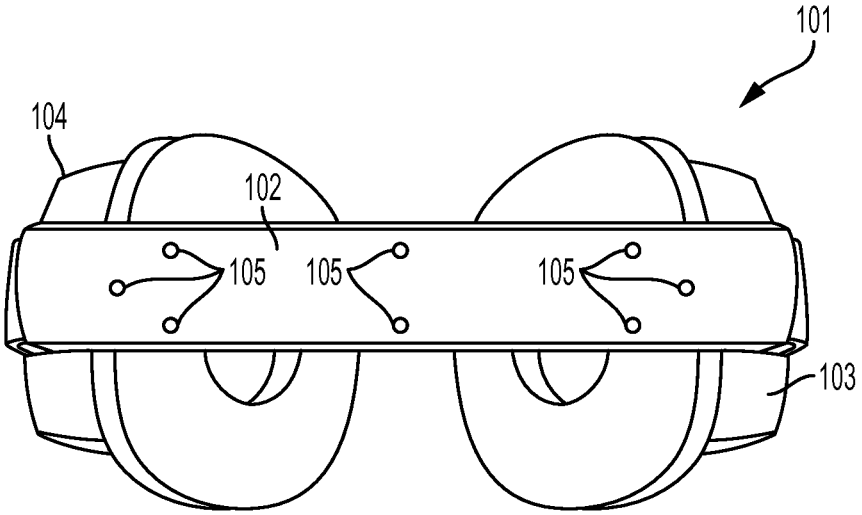
FIG. 2 shows a top view of a pair of headphones with a microphone array according to an embodiment of the invention.

FIG. 1 and FIG. 2 show a pair of headphones with an embodiment of a microphone array according to the invention. FIG. 2 shows a top view of a pair of headphones with a microphone array.

The headphones 101 may include a headband 102. The headband 102 may form an arc which, when in use, sits over the user's head. The headphones 101 may also include ear speakers 103 and 104 connected to the headband 102. The ear speakers 103 and 104 are colloquially referred to as "cans." A plurality of microphones 105 may be mounted on the headband 102. There should be three or more microphones where at least one of the microphones is not positioned co-linearly with the other two microphones in order to identify azimuth.

The microphones in the microphone array may be mounted such that they are not obstructed by the structure of the headphones or the user's body. Advantageously the microphone array is configured to have a 360-degree field. An obstruction exists when a point in the space around the array is not within the field of sensitivity of at least two microphones in the array. An accelerometer 106 may be mounted in an ear speaker housing 103.

Figure 3:
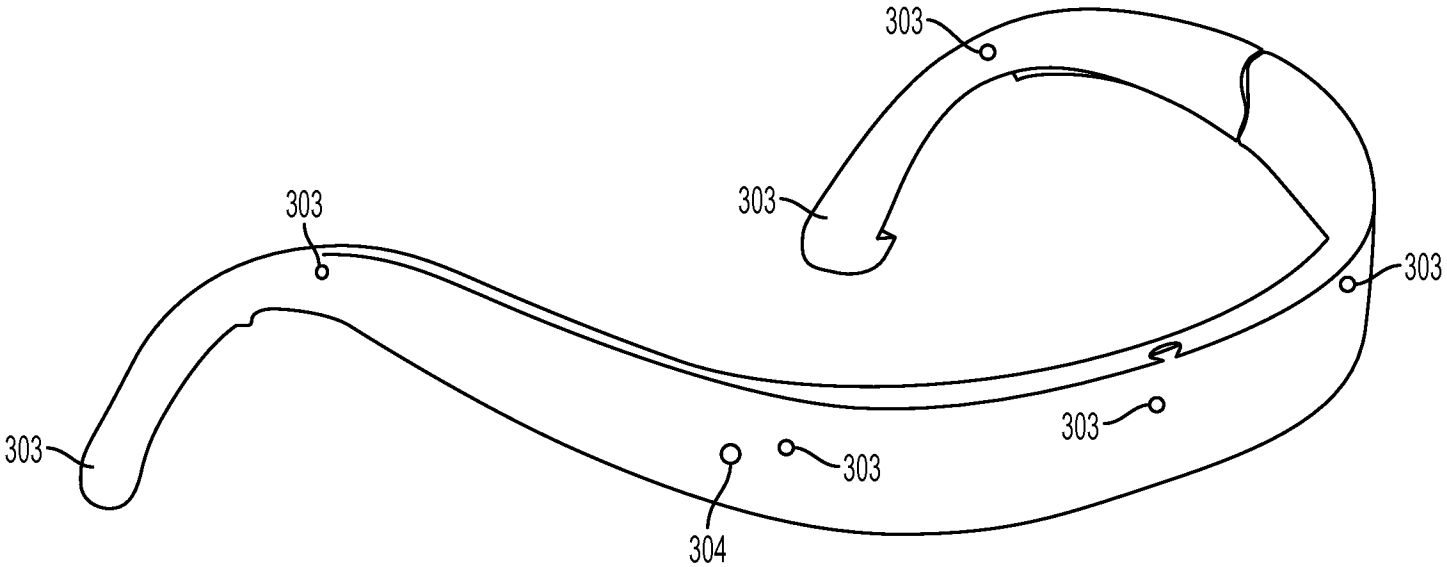
FIG. 3 shows a collar-mounted microphone array.
Figure 4:
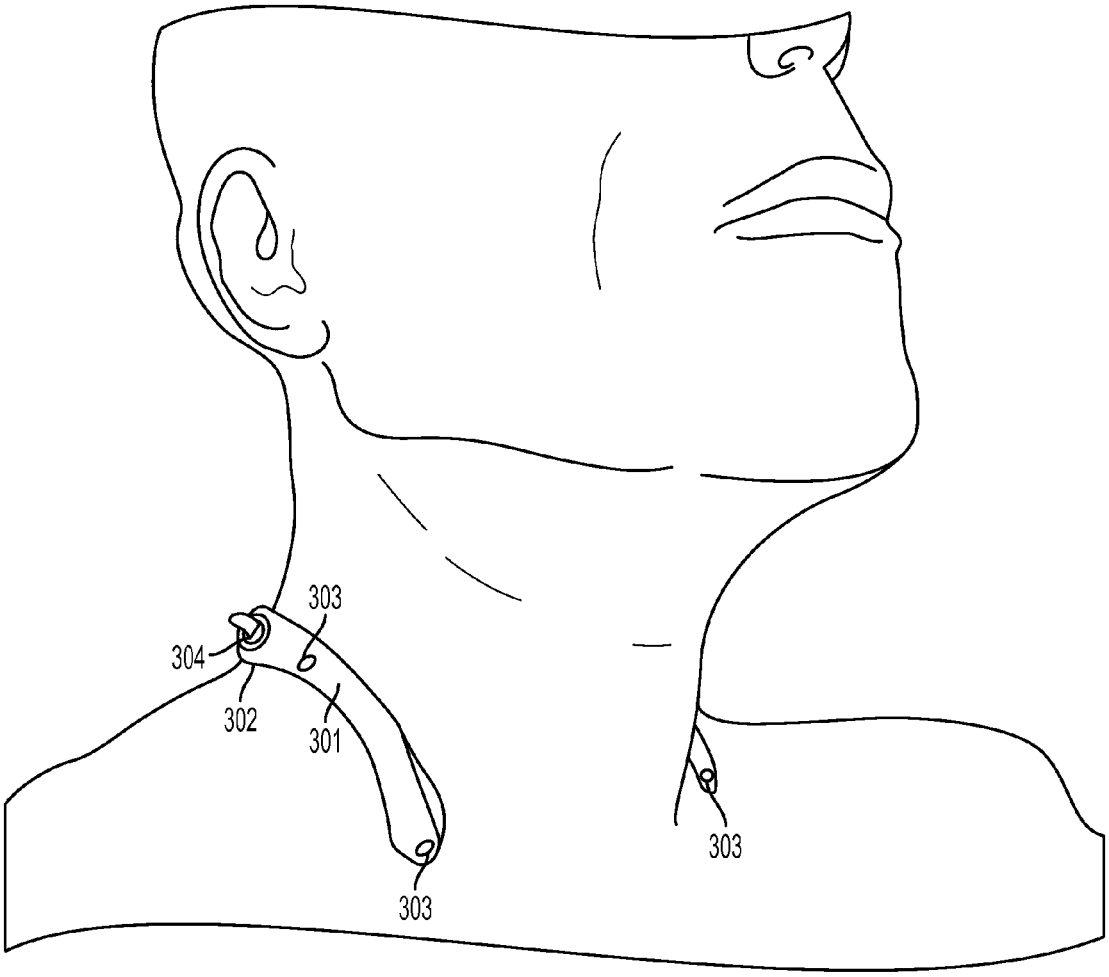
FIG. 4 illustrates a collar-mounted microphone array positioned on a user.

FIG. 3 and FIG. 4 show a collar-mounted microphone array 301.

FIG. 4 illustrates the collar-mounted microphone array 301 positioned on a user. A collar-band 302 adapted to be worn by a user is shown. The collar-band 302 is a mounting substrate for a plurality of microphones 303. The microphones 303 may be circumferentially-distributed on the collar-band 302, and may have a geometric configuration which may permit the array to have a 360-degree range with no obstructions caused by the collar-band 302 or the user. The collar-band 302 may also include an accelerometer 304 rigidly-mounted on or in the collar band 302.

Figure 5:
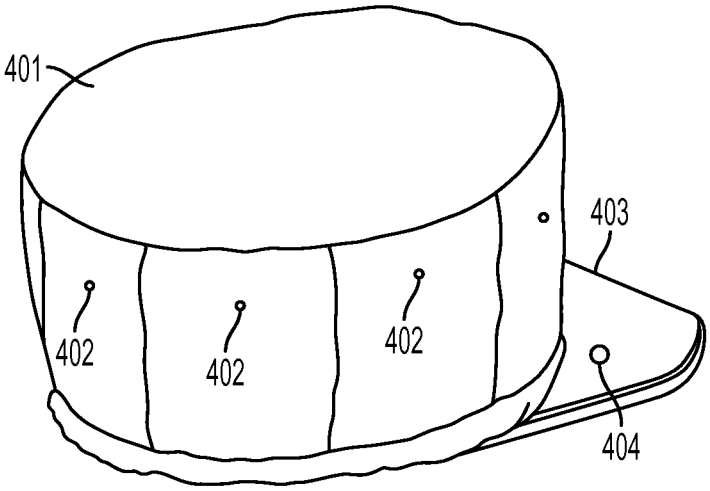
FIG. 5 illustrates a hat-mounted microphone array according an embodiment of the invention.

FIG. 5 illustrates a hat-mounted microphone array. FIG. 5 illustrates a hat 401. The hat 401 serves as the mounting substrate for a plurality of microphones 402. The microphones 402 may be circumferentially-distributed around the hat or on the top of the hat in a fashion that avoids the hat or any body parts from being a significant obstruction to the view of the array. The hat 401 may also carry on accelerometer 404. The accelerometer 404 may be mounted on a visor 503 of the hat 401. The hat mounted array in FIG. 5 is suitable for a 360-degree view (azimuth), but not necessarily elevation.

Figure 6:
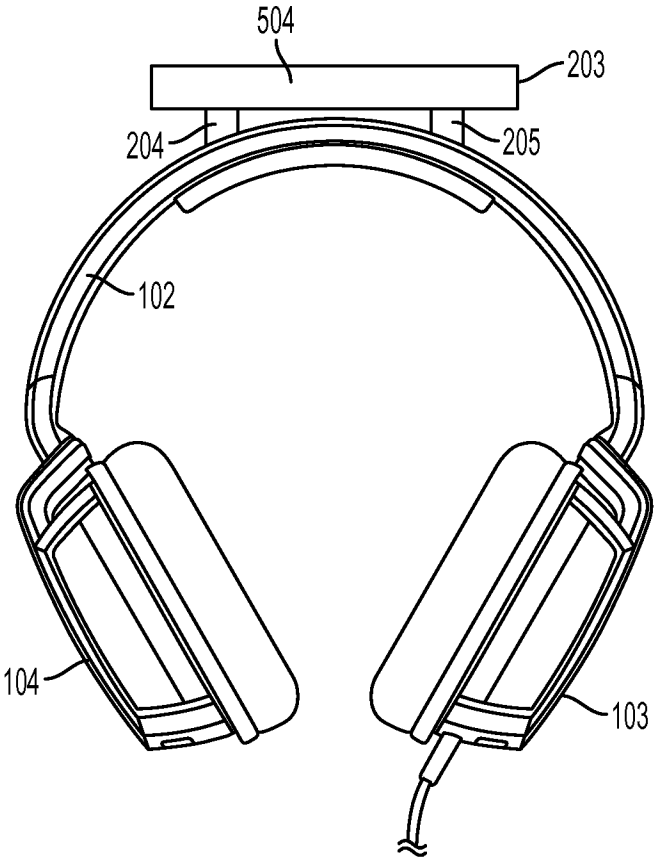
FIG. 6 shows a further embodiment of a microphone array according to an embodiment of the invention.

FIG. 6 shows a further embodiment of a microphone array. A substrate is adapted to be mounted on a headband of a set of headphones. The substrate may include three or more microphones 502.

A substrate 203 may be adapted to be mounted on headphone headband 102. The substrate 203 may be connected to the headband 102 by mounting legs 204 and 205. The mounting legs 204 and 205 may be resilient in order to absorb vibration induced by the ear speakers and isolate microphones and an accelerometer in the array.

Figure 7:
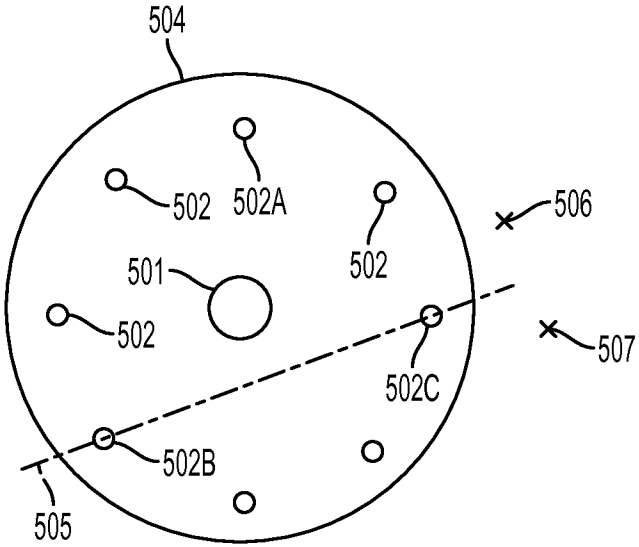
FIG. 7 shows a top view of a mounting substrate.

FIG. 7 shows a top view of a mounting substrate 203. Microphones 502 are mounted on the substrate 203. Advantageously an accelerometer 501 is also mounted on the substrate 203. The microphones alternatively may be mounted around the rim 504 of the substrate 203. According to an embodiment, there may be three microphones 502 mounted on the substrate 203 where a first microphones is not co-linear with a second and third microphone. Line 505 runs through microphone 502B and 502C. As illustrated in FIG. 7, the location of microphone 502A is not co-linear with the locations of microphones 502B and 502C as it does not fall on the line defined by the location of microphones 502B and 502C. Microphones 502A, 502B and 502C define a plane. A microphone array of two omni-directional microphones 502B and 502C cannot distinguish between locations 506 and 507. The addition of a third microphone 502A may be utilized to differentiate between points equidistant from line 505 that fall on a line perpendicular to line 505.

According an advantageous feature, an accelerometer may be provided in connection with a microphone array. Because the microphone array is configured to be carried by a person, and because people move, an accelerometer may be used to ascertain change in position and/or orientation of the microphone array. It is advantageous that the accelerometer be in a fixed position relative to the microphones 502 in the array, but need not be directly mounted on a microphone array substrate. An accelerometer 106 may be mounted in an ear speaker housing 103 shown in FIG. 1. An accelerometer 304 may be mounted on the collar-band 302 as illustrated in FIG. 4. An accelerometer may be mounted in a fixed position on the hat 401 illustrated in FIG. 5, for example, on a visor 403. The accelerometer may be mounted in any position. The position 404 of the accelerometer is not critical.

Figure 8:
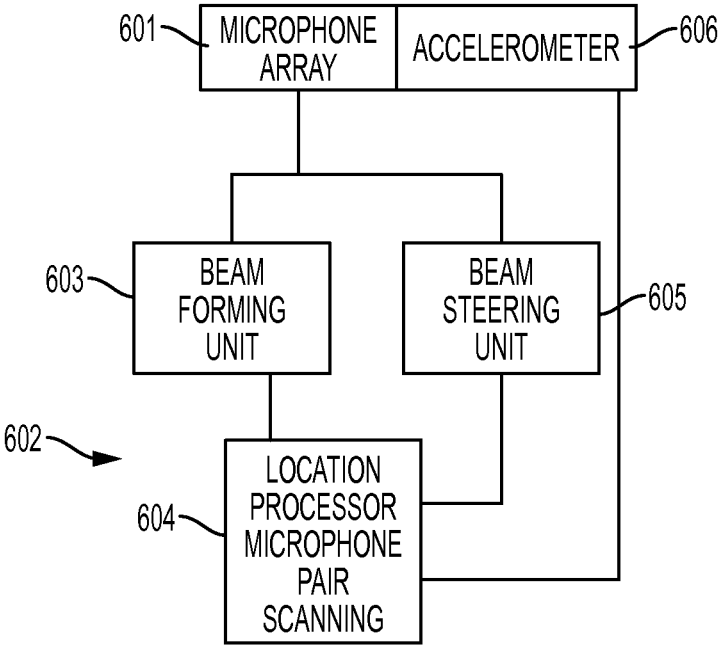
FIG. 8 shows a microphone array 601 in an audio source location and isolation system.

FIG. 8 shows a microphone array 601 in an audio source location and isolation system. A beam-forming unit 603 is responsive to a microphone array 601. The beamforming unit 603 may process the signals from two or more microphones in the microphone array 601 to determine the location of an audio source, preferably the location of the audio source relative to the microphone array. A location processor 604 may receive location information from the beam-forming system 603. The location information may be provided to a beam-steering unit 605 to process the signals obtained from two or more microphones in the microphone array 601 to isolate audio emanating from the identified location. A two-dimensional array is generally suitable for identifying an azimuth direction of the source. An accelerometer 606 may be mechanically coupled to the microphone array 601. The accelerometer 606 may provide information indicative of a change in location or orientation of the microphone array. This information may be provided to the location processor 604 and utilized to narrow a location search by eliminating change in the array position and orientation from any adjustment of beam-forming and beam-scanning direction due to change in location of the audio source. The use of an accelerometer to ascertain change in position and/or change in orientation of the microphone array 601 may reduce the computational resources required for beam forming and beam scanning.

Figure 9:
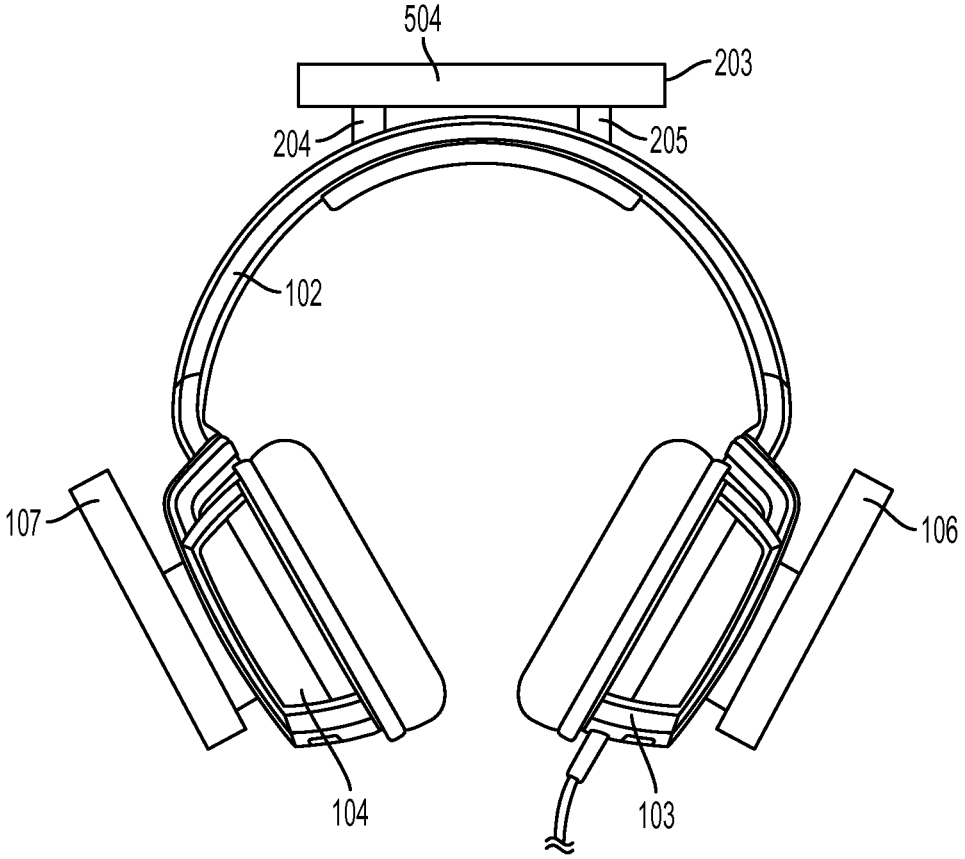
FIG. 9 shows a front view of an embodiment according to the invention.

FIG. 9 shows a front view of a headphone fitted with a microphone array suitable for sensing audio information to locate an audio object in three-dimensional space.

An azimuthal microphone array 203 may be mounted on headphones. An additional microphone array 106 may be mounted on ear speaker 103. Microphone array 106 may include one or more microphones 108 and may be acoustically and/or vibrationally isolated by a damping mount from the earphone housing. According to an embodiment, there may be more than one microphone 108. The microphones may be dispersed in the same configuration illustrated in FIG. 7.

A microphone array 107 may be mounted on ear speaker 104. Microphone array 107 may have the same configuration as microphone array 106.

Microphones may be embedded in the ear speaker housing and the ear speaker housing may also include noise and vibration damping insulation to isolate or insulate the microphones 108 from the acoustic transducer in the ear speakers 103 and 104.

Three non-co-linear microphones in an array may define a plane. A microphone array that defines a plane may be utilized for source detection according to azimuth, but not according to elevation. At least one additional microphone 108 may be provided in order to permit source location in three-dimensional space. The microphone 108 and two other microphones define a second plane that intersects the first plane. The spatial relationship between the microphones defining the two planes is a factor, along with sensitivity, processing accuracy, and distance between the microphones that contributes to the ability to identify an audio source in a three-dimensional space.

In a physical embodiment mounted on headphones, a configuration with microphones on both ear speaker housings reduces interference with location finding caused by the structure of the headphones and the user. Accuracy may be enhanced by providing a plurality of microphones on or in connection with each ear speaker.

Figure 10:
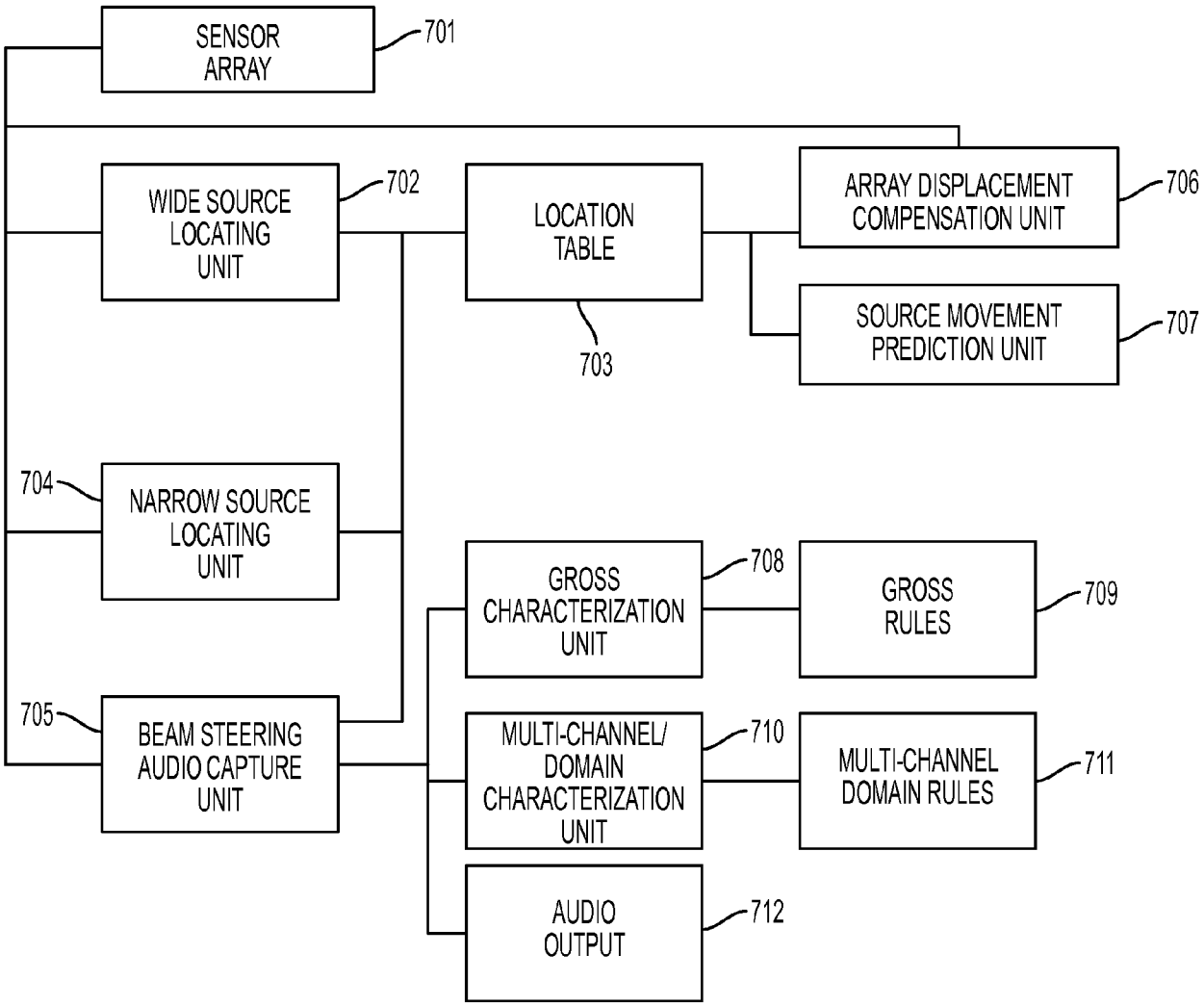
FIG. 10 shows an embodiment of the audio source location tracking and isolation system.

FIG. 10 shows an audio source location tracking and isolation system. The system includes a sensor array 701. Sensor array 701 may be stationary. According to a particularly useful embodiment the sensor array 701 may be body-mounted or adapted for mobility. The sensor array 701 may include a microphone array. The microphone array may have two or more microphones. The sensor array may have three microphones in order to be capable of a 360-degree azimuth range. The sensor array may have four or more microphones in order to have a 360-degree azimuth and an elevation range. The 360-degree azimuth requires that the three microphones be non-co-linear and the elevation-capable array must have at least three non-co-linear microphones defining a first plane and at least three non-co-linear microphones defining a second plane intersecting the first plane provided that two of the three microphones defining the second plane may be two of the three microphones also defining the first plane.

In the event that the sensor array 701 is adapted to be portable or mobile, it is advantageous to also include an accelerometer rigidly-linked to the sensor array.

A wide source locating unit 702 may be responsive to the sensor array. The wide source locating unit 702 is able to detect audio sources and their general vicinities. Advantageously the wide source locating unit 702 has a full range of search. The wide source locating unit may be configured to generally identify the direction and/or location of an audio source and record the general location in a location table 703. The system is also provided with a narrow source locating unit 704 also connected to sensor array 701. The narrow source locating unit 704 operates on the basis of locations previously stored in the location table 703. The narrow source locating unit 704 will ascertain a pinpoint location of an audio source in the general vicinity identified by the entries in a location table 703. The pinpoint location may be based on narrow source locations previously stored in the location table or wide source locations previously stored in the location table. The narrow source location identified by the narrow source locating unit 704 may be stored in the location table 703 and replaced the prior entry that formed a basis for the narrow source locating unit scan. The system may also be provided with a beam steering audio capture unit 705. The beam steering audio capture unit 705 responds to the pinpoint location stored in the location table 703. The beam steering audio capture unit 705 may be connected to the sensor array 701 and captures audio from the pinpoint locations set forth in the location table 703.

The location table may be updated on the basis of new pinpoint locations identified by the narrow source locating unit 704 and on the basis of an array displacement compensation unit 706 and/or a source movement prediction unit 707. The array displacement compensation unit 706 may be responsive to the accelerometer rigidly attached to the sensor array 701. The array displacement compensation unit 706 ascertains the change in position and orientation of the sensor array to identify a location compensation parameter. The location compensation parameter may be provided to the location table 703 to update the pinpoint location of the audio sources relative to the new position of the sensor array.

Source movement prediction unit 707 may also be provided to calculate a location compensation for pinpoint locations stored in the location table. The source movement prediction unit 707 can track the interval changes in the pinpoint location of the audio sources identified and tracked by the narrow source locating unit 704 as stored in the location table 703. The source movement prediction unit 707 may identify a trajectory over time and predict the source location at any given time. The source movement prediction unit 707 may operate to update the pinpoint locations in the location table 703.

The audio information captured from the pinpoint location by the beam steering audio capture unit 705 may be analyzed in accordance with an instruction stored in the location table 703. Upon establishment of a pinpoint location stored in the location table 703, it may be advantageous to identify the analysis level as gross characterization. The gross characterization unit 708 operates to assess the audio sample captured from the pinpoint location using a first set of analysis routines. The first set of analysis routines may be computationally non-intensive routines such as analysis for repetition and frequency band. The analysis may be voice detection, cadence, frequencies, or a beacon. The audio analysis routines will query the gross rules 709. The gross rules may indicate that the audio satisfying the rules is known and should be included in an audio output, known and should be excluded from an audio output or unknown. If the gross rules indicate that the audio is of a known type that should be included in an audio output, the location table is updated and the instruction set to output audio coming from that pinpoint location. If the gross rules indicate that the audio is known and should not be included, the location table may be updated either by deleting the location so as to avoid further pinpoint scans or simply marking the location entry to be ignored for further pinpoint scans.

If the result of the analysis by the gross characterization unit 708 and the application of rules 709 is of unknown audio type, then the location table 703 may be updated with an instruction for multi-channel characterization. Audio captured from a location where the location table 703 instruction is for multi-channel analysis, [audio] may be passed to the multi-channel/multi-domain characterization unit 710. The multi-channel/multi-domain characterization unit 710 carries out a second set of audio analysis routines. It is contemplated that the second set of audio analysis routines is more computationally intensive than the first set of audio analysis routines. For this reason the second set of analysis routines is only performed for locations which the audio has not been successfully identified by the first set of audio analysis routines. The result of the second set of audio analysis routines is applied to the multi-channel/multi-domain rules 711. The rules may indicate that the audio from that source is known and suitable for output, known and unsuitable for output or unknown. If the multi-channel/multi-domain rules indicate that the audio is known and suitable for output, the location table may be updated with an output instruction. If the multi-channel/multi-domain rules indicate that the audio is unknown or known and not suitable for output, then the corresponding entry in the location table is updated to either indicate that the pinpoint location is to be ignored in future scans and captures, or by deletion of the pinpoint location entry.

When the beam steering audio capture unit 705 captures audio from a location stored in location table 703 and is with an instruction as suitable for output, the captured audio from the beam steering audio capture unit 705 is connected to an audio output 712.

The techniques, processes and apparatus described may be utilized to control operation of any device and conserve use of resources based on conditions detected or applicable to the device.

The invention is described in detail with respect to preferred embodiments, and it will now be apparent from the foregoing to those skilled in the art that changes and modifications may be made without departing from the invention in its broader aspects, and the invention, therefore, as defined in the claims, is intended to cover all such changes and modifications that fall within the true spirit of the invention.

Thus, specific apparatus for and methods of audio signature generation and automatic content recognition have been disclosed. It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. An audio processing system comprising:

a body mounted microphone array;

an accelerometer linked to said microphone array;

an audio source locating unit connected to said microphone array having an output representative of a location of an audio source;

a location table connected to said output of said audio source locating unit containing a representation of a location of one or more audio sources; and an array displacement compensation unit having an input connected to an output of said accelerometer and an output representative of a change in position of said accelerometer, wherein said location table is responsive to said output representative of a change in position of said accelerometer to update the representation of said one or more audio sources to compensate for said change in position of said accelerometer.

2. An audio processing system according to claim 1 further comprising a localized audio capture unit connected to said microphone array and said location table to capture and isolate audio information from one or more locations specified by said representation of a location of said one or more audio sources.

3. An audio processing system according to claim 2 further comprising an audio output connected to said audio capture unit.

4. An audio processing system according to claim 2 further comprising an audio analysis unit having an input connected to said audio capture unit and gating logic responsive to an output of said audio analysis unit.

5. An audio processing system according to claim 4 wherein an output of said gating logic is connected to said location table.

6. An audio processing system according to claim 5 wherein said audio analysis unit is configured to perform two or more sets of audio analysis operations.

7. An audio processing system according to claim 6 wherein said gating logic comprises two or more sets of gating functions corresponding to said two or more sets of audio analysis operations.

8. An audio processing system according to claim 7 further comprising an audio output connected to said audio capture unit.

9. An audio processing system according to claim 5 further comprising an audio output connected to said audio capture unit.

10. An audio processing system according to claim 1 further comprising a source movement prediction unit having an input connected to said location table and an output representative of anticipated change of audio source location based on trajectory of audio source locations over time, connected to said location table, wherein said location table is responsive to said output of said source movement prediction unit to update the representation of said location of said audio source.

11. An audio processing system according to claim 6 wherein at least one set of audio analysis operations is a set of gross characterization operations.

12. An audio processing system according to claim 11 wherein at least one set of audio analysis operations is a set of multi-channel analysis operations.

13. An audio processing system according to claim 12 wherein at least one set of audio analysis operations is a set of multi-domain analysis operations.

14. An audio processing system according to claim 11 wherein at least one set of audio analysis operations is a set of multi-domain analysis operations.

* * * * *